US011707931B2

(12) United States Patent
Uda et al.

(10) Patent No.: US 11,707,931 B2
(45) Date of Patent: Jul. 25, 2023

(54) INKJET PRINTING APPARATUS

(71) Applicant: SCREEN HOLDINGS CO., LTD., Kyoto (JP)

(72) Inventors: Takahiro Uda, Kyoto (JP); Mitsuru Tanemoto, Kyoto (JP); Yuki Tsutsui, Kyoto (JP); Masaki Era, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 2 days.

(21) Appl. No.: 17/587,391

(22) Filed: Jan. 28, 2022

(65) Prior Publication Data

US 2022/0288928 A1 Sep. 15, 2022

(30) Foreign Application Priority Data

Mar. 10, 2021 (JP) ..... 2021-038355

(51) Int. Cl.
*B41J 2/145* (2006.01)
*B41J 13/00* (2006.01)

(52) U.S. Cl.
CPC ..... *B41J 2/145* (2013.01); *B41J 13/0009* (2013.01)

(58) Field of Classification Search
CPC ..... B41J 2/145; B41J 13/0009; B41J 11/002
See application file for complete search history.

(56) References Cited

U.S. PATENT DOCUMENTS

2009/0295894 A1 12/2009 Hori

FOREIGN PATENT DOCUMENTS

JP 2003-170573 A 6/2003
WO 2008/069070 A1 6/2008
WO WO-2021117525 A1 * 6/2021

OTHER PUBLICATIONS

Extended European Search Report issued in corresponding European Patent Application No. 22154331.7-1014, dated Jul. 7, 2022.

* cited by examiner

*Primary Examiner* — Justin Seo

(74) *Attorney, Agent, or Firm* — McDermott Will & Emery LLP

(57) ABSTRACT

An inkjet printing apparatus for printing on a printing medium by dispensing inks thereto. The apparatus includes a transport device; print heads for performing printing by dispensing the inks to the printing medium; and a drying section including a heat source for generating heat for drying the inks dispensed to the printing medium, and a shutter switchable between an open state and a closed state. In the open state, a drying amount of heat is applied for drying the inks dispensed to the printing medium, and in the closed state, the heat from the heat source is applied in a minute amount of heat smaller than the drying amount of heat. A controller switches the shutter to the open state when a transporting speed of the printing medium is faster than a predetermined threshold, and switches the shutter to the closed state when the transporting speed of the printing medium becomes equal to or less than the predetermined threshold.

12 Claims, 5 Drawing Sheets

TRANSPORTING SPEED [mpm]
Vp
V1
Ve
0
t
t1 t2 t3 t4 t5 t6 t7 t8 t9 t10 t11 t12 t13 t14 t15
TEMPORARY STOP REQUEST
CANCELLATION OF TEMPORARY STOP REQUEST SHUTTER STATE
OPEN
CLOSED
t
t1 t2 t3 t4 t5 t6 t7 t8 t9 t10 t11 t12 t13 t14 t15

INKJET PRINTING APPARATUS

BACKGROUND OF THE INVENTION

(1) Field of the Invention

This invention relates to an inkjet printing apparatus for performing printing by dispensing inks to a printing medium, and more particularly to a technique for drying the inks dispensed to the printing medium.

(2) Description of the Related Art

Conventionally, this type of apparatus includes a transport device, inkjet heads, and a drying section. See Japanese Unexamined Patent Publication No. 2003-170573, particularly paragraph No. 0024 thereof, for example.

The transport device in this apparatus transports web paper. The inkjet heads perform printing by dispensing inks to the web paper transported by the transport device. The drying section, which is disposed downstream of the inkjet heads, dries the inks dispensed to the web paper. The drying section includes a carbon heater and a shutter, for example. The carbon heater applies heat to the inks dispensed to the web paper. The shutter is open when the heat of the carbon heater is applied, and is closed when the heat is not applied. While a printing process is going on, the shutter is maintained open, and the shutter is closed only when an abnormality occurs to the apparatus.

However, the conventional example with such a construction has the following problem.

That is, with the conventional apparatus, when stagnation occurs to a subsequent processing apparatus in a downstream stage, the subsequent processing apparatus may request a temporary stop of the processing. In this case, where an inkjet printing mode is employed, instead of completely stopping the transportation, the printing is continued, for example, with an ultraslow transporting speed realized by slowing down from a transporting speed provided in printing conditions. When the subsequent processing apparatus cancels the request for the temporary stop, acceleration is made toward the transporting speed provided in the printing conditions. With the printing continuously performed in this way, since the transporting speed is not zero, the drying section has the shutter remaining open. Consequently, the inks dispensed to the web paper become overdried, which makes an ink dryness difference from pre-deceleration areas, and hence a problem of ink dryness variations.

SUMMARY OF THE INVENTION

This invention has been made having regard to the state of the art noted above, and its object is to provide an inkjet printing apparatus which can suppress ink dryness variations even when printing is performed at ultraslow speed.

To fulfill the above object, this invention provides the following construction.

An inkjet printing apparatus for printing on a printing medium by dispensing inks thereto, according to this invention, comprises a transport device for transporting the printing medium in a predetermined transport direction; print heads for performing printing by dispensing the inks to the printing medium transported by the transport device; a drying section disposed downstream of the print heads for drying the inks dispensed to the printing medium, and including a heat source for generating heat for drying the inks dispensed to the printing medium, and a shutter switchable between an open state and a closed state, in the open state the heat from the heat source being applied in a drying amount of heat for drying the inks dispensed to the printing medium, and in the closed state the heat from the heat source being applied in a minute amount of heat smaller than the drying amount of heat; and a controller for switching the shutter to the open state when a transporting speed of the printing medium by the transport device is faster than a predetermined threshold, and switching the shutter to the closed state when the transporting speed of the printing medium by the transport device becomes equal to or less than the predetermined threshold.

According to this invention, the controller switches the shutter to the open state when the transporting speed of the printing medium by the transport device is faster than the predetermined threshold, and switches the shutter to the closed state when the transporting speed of the printing medium by the transport device becomes equal to or less than the predetermined threshold. Consequently, when the transporting speed is faster than the predetermined threshold, drying is done by the drying amount of heat. When the transporting speed is a low speed equal to or less than the predetermined threshold, drying is done by the minute amount of heat which is less in amount of heat than the drying amount of heat. Thus, there is no chance of overdrying the inks dispensed to the printing medium even when printing is performed at an ultraslow speed. This can suppress dryness variations of the inks dispensed to the printing medium.

In this invention, it is preferred that the drying section further includes an opening and closing speed regulating device for regulating an opening and closing speed of the shutter; and the controller is configured to operate through the opening and closing speed regulating device to switch the shutter to the closed state at low speed at a point of time the transporting speed reaches the threshold when the transport device starts deceleration from a transporting speed higher than the threshold, and operate through the opening and closing speed regulating device to switch the shutter to the open state at low speed at a point of time the transporting speed reaches the threshold when the transport device starts acceleration from an ultraslow transporting speed lower than the threshold.

After the transport device starts deceleration from a predetermined transporting speed, the controller operates through the opening and closing speed regulating device to switch the shutter to the closed state at low speed at a point of time when the transporting speed reaches the threshold. After the transport starts acceleration from the ultraslow transporting speed, the controller operates through the opening and closing speed regulating device to switch the shutter to the open state at low speed at the point of time when the transporting speed reaches the threshold. Thus, while the transporting speed is shifting, the amount of heat applied from the drying section to the printing medium can be gradually decreased or increased. This can also suppress dryness variations of the inks occurring while the transporting speed is shifting.

In this invention, it is preferred that the drying section further includes a ventilating mechanism for sending the heat generated from the heat source toward the printing medium, and in the closed state the ventilating mechanism applies the minute amount of heat to the printing medium.

With the ventilating mechanism of the drying section sending currents of air, the minute amount of heat from the heat source which is smaller than the drying amount of heat can be applied to the printing medium. Cost can be held down since a separate heat source is not required.

In this invention, it is preferred that the drying section further includes an adjusting device for adjusting an amount of heat generated by the heat source; the controller further includes a storage unit for storing, written in beforehand, a first mathematical expression for the closed state and a second mathematical expression for the open state, expressing the amount of heat generated by the heat source which is variable to be the higher, the faster, and to be the lower, the slower the transporting speed by the transport device is; and the controller is configured to operate the adjusting device to link the first mathematical expression and the second mathematical expression when switching the shutter to the closed state at low speed and when switching the shutter to the open state at low speed.

The controller operates the adjusting device to link the first mathematical expression and the second mathematical expression when switching the shutter to the closed state at low speed and when switching the shutter to the open state at low speed. Thus, the amount of heat generated by the heat source can be smoothly increased and decreased. This can further suppress dryness variations of the inks occurring when the shutter is opened and closed at low speed.

In this invention, it is preferred that the controller is configured to decelerate the transportation by the transport device to an ultraslow speed when a temporary stop request is received from a subsequent processing apparatus disposed downstream of the drying section.

When the subsequent processing apparatus requests a temporary stop, the controller decelerates the transportation by the transport device to the ultraslow speed. Thus, while coping with the request from the subsequent processing apparatus, it is possible to maintain the quality of prints when the transporting speed returns to normal.

In this invention, it is preferred that the controller is configured to accelerate the transportation by the transport device to a predetermined speed faster than an ultraslow speed when a temporary stop request is cancelled by a subsequent processing apparatus disposed downstream of the drying section.

When the subsequent processing apparatus cancels the temporary stop request, the controller accelerates the transportation by the transport device to the predetermined speed faster than the ultraslow speed. Thus, while coping with the request from the subsequent processing apparatus, it is possible to return the printing throughput to an original level.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

An embodiment of this invention will be described hereinafter.

Figure 1:
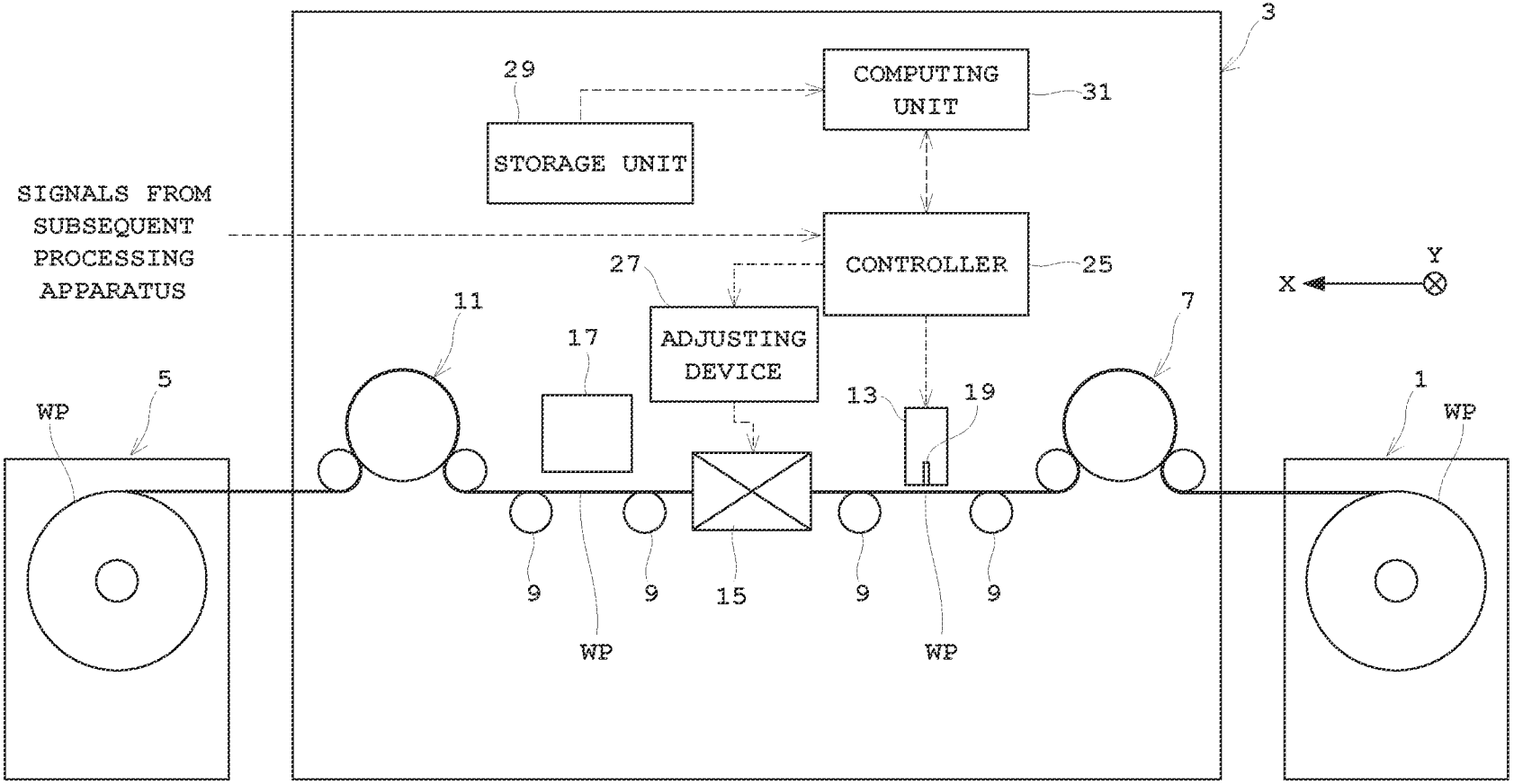
FIG. 1 is a schematic overall view of an inkjet printing system diagram according to an embodiment.

FIG. 1 is a schematic overall view of an inkjet printing system according to the embodiment.

The inkjet printing system according to this embodiment includes a sheet feeder 1, an inkjet printing apparatus 3, and a takeup roller 5. The sheet feeder 1 holds web paper WP in a roll form to be rotatable about a horizontal axis. The sheet feeder 1 unwinds the web paper WP and feeds it to the inkjet printing apparatus 3. The inkjet printing apparatus 3 prints images by dispensing inks to the web paper WP, and feeds the web paper WP to the takeup roller 5. The takeup roller 5 winds on a horizontal axis the web paper WP printed in the inkjet printing apparatus 3.

Here, the direction in which the web paper WP is fed by the sheet feeder 1 and transported is regarded as transport direction X. A horizontal direction perpendicular to the transport direction X is regarded as width direction Y. The above sheet feeder 1 is located upstream of the inkjet printing apparatus 3 in the transport direction X. The above takeup roller 5 is located downstream of the inkjet printing apparatus 3 in the transport direction X.

The above web paper WP corresponds to the "printing medium" in this invention.

The inkjet printing apparatus 3 includes a drive roller 7 disposed in an upstream position for taking in the web paper WP from the sheet feeder 1. The web paper WP unwound from the sheet feeder 1 by the drive roller 7 is fed in the transport direction X and transported toward the takeup roller 5 by a plurality of transport rollers 9. A drive roller 11 is disposed between the most downstream transport roller 9 and the takeup roller 5. This drive roller 11 feeds the web paper WP transported on the transport rollers 9 forward toward the takeup roller 5.

The inkjet printing apparatus 3 includes, between the drive roller 7 and drive roller 11, a printing unit 13, a drying section 15, and an inspecting device 17 arranged in the stated order from upstream. The printing unit 13 performs printing by dispensing inks to the web paper WP. The drying section 15 dries the inks dispensed from the printing unit 13 to the web paper WP. The inspecting device 17 checks whether portions printed on the web paper WP have stains, omissions or other defects.

The printing unit 13 includes inkjet heads 19 having a plurality of nozzles for dispensing the inks to the web paper WP. Generally, a plurality of inkjet heads 19 are arranged along the transport direction X of the web paper WP. For example, four printing units 13 are provided for black (K), cyan (C), magenta (M), and yellow (Y). In the following description, however, a construction having only one printing unit 13 will be taken for example. The printing unit 13 has a length in the width direction Y of the web paper WP that exceeds the width of the web paper WP. The printing unit 13 has the inkjet heads 19 enough to print on a printing area in the width direction of the web paper WP without moving in the width direction Y.

The inkjet printing apparatus 3 includes a controller 25 for performing overall control of the drive rollers 7 and 11, printing unit 13, drying section 15, and inspecting device 17. The controller 25 has, directly or indirectly connected thereto, an adjusting device 27, a storage unit 29, and a computing unit 31. The controller 25 is constructed of a CPU and memory, for example.

The adjusting device 27 is operated by the controller 25 to adjust an amount of heat in the drying section 15. The storage unit 29 stores, written in beforehand, a first mathematical expression and a second mathematical expression required for control of electric power described hereinafter. The computing unit 31 performs arithmetics, necessary for the control by the adjusting device 27, based on the first mathematical expression and second mathematical expression which are stored in the storage unit 29, the transporting speed of the web paper WP, and states of the drying section 15 described hereinafter. The controller 25 receives print data from a host computer (not shown) and operates each component described above to perform printing on the web paper WP. The controller 25 is operable as interlocked with subsequent processing apparatus arranged downstream of this ink jet printing system, such as a cutting apparatus and a bookbinding apparatus, for example. The controller 25 therefore receives signals from the subsequent processing apparatus.

The transport rollers 9 and drive rollers 7 and 11 described above correspond to the "transport device" in this invention.

Figure 2:
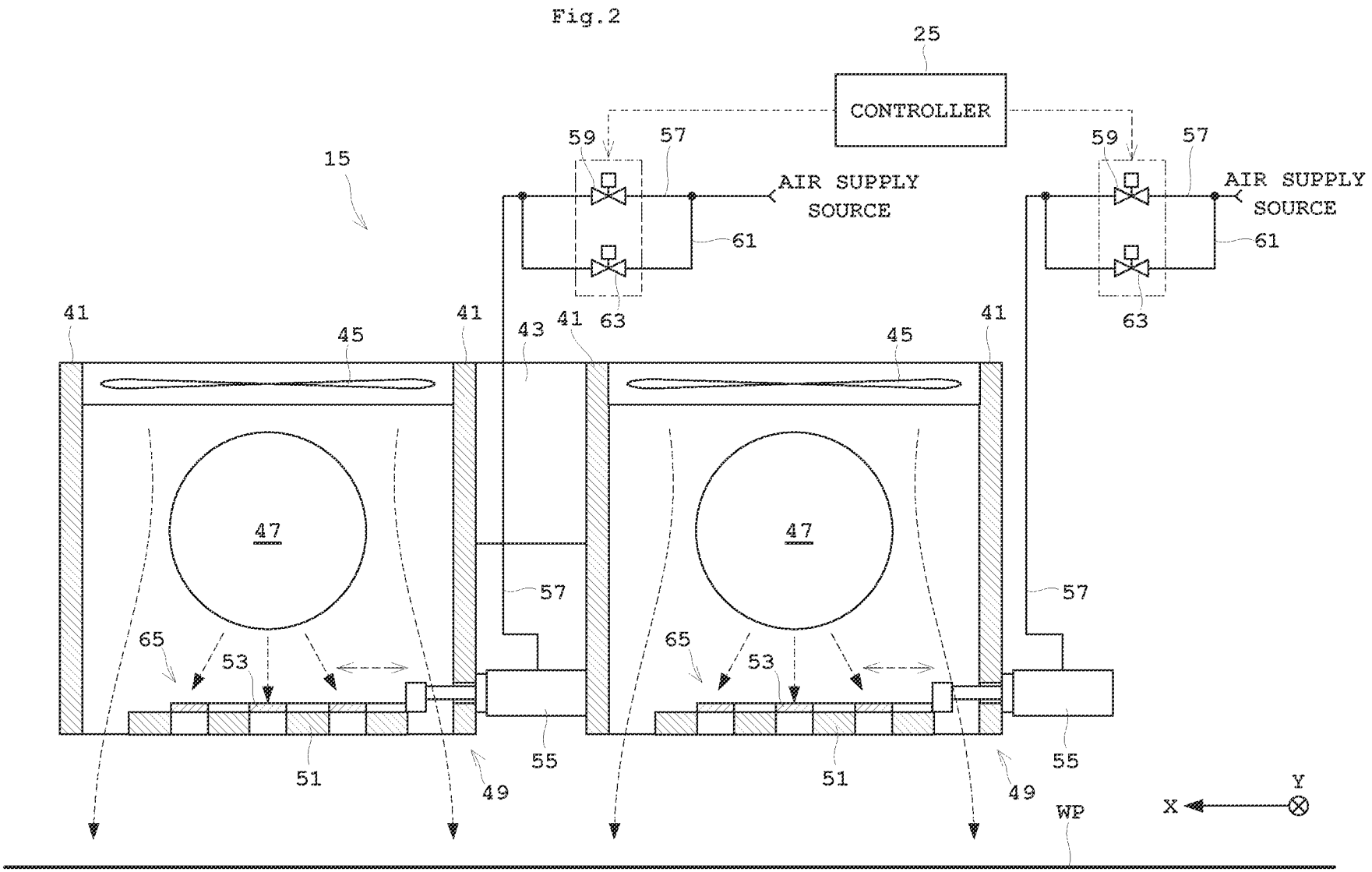
FIG. 2 is a view in vertical section showing a construction of a drying section with shutters in a closed state.
Figure 3:
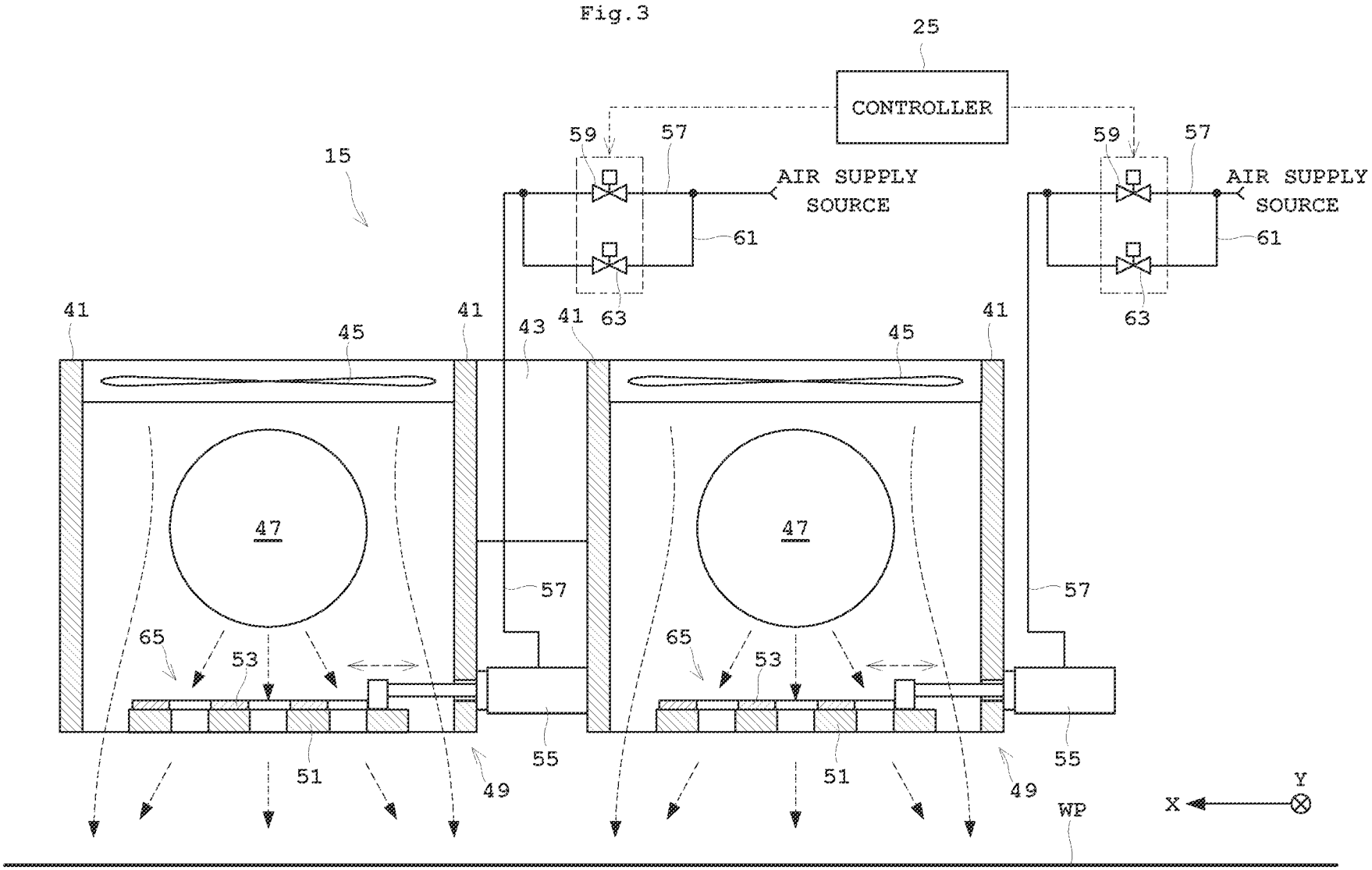
FIG. 3 is a view in vertical section showing the construction of the drying section with the shutters in an open state.

Next, the drying section 15 will be described in detail with reference to FIGS. 2 and 3. FIG. 2 is a view in vertical section showing a construction of the drying section 15 with shutters in a closed state. FIG. 3 is a view in vertical section showing the construction of the drying section with the shutters in an open state.

The drying section 15 is constructed of two housings 41 forming a pair, for example. The pair of housings 41 have the same internal constitution. The pair of housings 41 are fixed to each other by a connecting frame 43. Each housing 41 has a fan 45, a heater 47, and a shutter unit 49.

Each housing 41 assumes the shape of a cylinder extending through in an up-down direction. The fan 45 is attached to an upper part of the housing 41. The fan 45 forms currents of air downward from above. The heater 47 is attached below the fan 45. The fan 45 supplies the air warmed by the heater 47 toward the web paper WP. The heater 47 is attached to the housing 41 to form gaps with inner walls of the housing 41 which correspond to upstream and downstream sides in the transport direction X. These gaps provide passages for the air to flow downward from the fan 45. The heater 47 is constructed of a halogen heater, for example. The halogen heater generates heat for drying materials by taking out light of the infrared region emitted from a halogen lamp. The heater 47 directs the emitted light of the infrared region to an upper surface of the shutter unit 49.

The shutter unit 49 includes a fixed frame 51, a movable frame 53, and an air cylinder 55, for example. The fixed frame 51 has a plurality of penetrating openings, and is attached to a lower part of the housing 41. The movable frame 53 has a plurality of penetrating openings as does the fixed frame 51, and is mounted on an upper surface of the fixed frame 51. The movable frame 53 is mounted to be slidable on the upper surface of the fixed frame 51 along the transport direction X. The movable frame 53 has an actuator shaft of the air cylinder 55 connected to one position thereof. The air cylinder 55 is attached to a side of the housing 41 with the actuator shaft in a posture to advance and retract horizontally, for example. The air cylinder 55, by supply and exhaustion of air, drives the actuator shaft to advance and retract. The advance/retract speed of the actuator shaft is regulated by flow rate of the air supplied.

The air cylinder 55 has one end of a supply pipe 57 connected thereto. The other end of the supply pipe 57 is connected to an air supply source. The air supply source supplies air under predetermined pressure. The supply pipe 57 has a switch valve 59 mounted on a part thereof. The supply pipe 57 has a branch pipe 61 attached thereto for bypassing the switch valve 59. The branch pipe 61 has a switch valve 63 mounted thereon. The branch pipe 61 has a smaller flow passage cross-section area than the supply pipe 57. Consequently, a flow rate, when air is circulated only through the branch pipe 61, is smaller than a flow rate when air is circulating only through the supply pipe 57. The switch valves 59 and 63 are opened and closed by the controller 25.

This specification omits a graphic illustration and description about a mechanism relating to air exhaust at the time of extending and contracting the actuator shaft of the air cylinder 55. By way of description, therefore, the actuator shaft is extended when air is supplied to the air cylinder 55, and this state is maintained even when the switch valves 59 and 63 are thereafter closed. It is assumed that, in this state, the actuator shaft is contracted when air is supplied to the air cylinder 55. That is, description will be made such that, whenever air is supplied to the air cylinder 55, switching is made between extending operation and contracting operation of the actuator shaft.

It is assumed here that, at normal times, the shutter unit 49 is in the state shown in FIG. 2. In other words, the actuator shaft of the air cylinder 55 is in the contracted state at normal times. In this state, the openings of the movable frame 53 and the openings of the fixed frame 51 are staggered in a longitudinal direction, whereby bar members of the movable frame 53 will be in a state of closing the openings of the fixed frame 51. Provided here that the fixed frame 51 and movable frame 53 in combination are called a shutter 65, the shutter 65 is in the closed state. When the controller 25 extends the actuator shaft of the air cylinder 55 in this state, as shown in FIG. 3, the openings of the movable frame 53 and the openings of the fixed frame 51 become aligned in the longitudinal direction. That is, the shutter 65 is in the open state.

The drying section 15 constructed in this way can provide two roughly varied stages in the amount of heat based on the open state and closed state of the shutter 65. Moreover, the two stages in the amount of heat can be switched in a short time. In order to control the amount of heat finely, what is necessary is to control the electric power applied to the heater 47.

First, a large amount of heat is called "drying amount of heat". This drying amount of heat is an amount of heat given to the web paper WP from the drying section 15 with the shutter 65 opened. The state of the shutter 65 being open is shown in FIG. 3. In this state, the light emission of the infrared region by the heater 47 and the ventilation of heated air by the fan 45 are performed at the same time. Consequently, the drying amount of heat with the large amount of heat can be applied to the web paper WP.

Next, the amount of heat smaller than the above drying amount of heat is called "minute amount of heat". This minute amount of heat is an amount of heat given to the web paper WP from the drying section 15 with the shutter 65 closed. The state of the shutter 65 being closed is shown in FIG. 2. In this state, the light emission of the infrared region by the heater 47 is not directly performed on the web paper WP. Only the ventilation of heated air is performed by the fan 45.

The controller 25 controls the shutter unit 49 to open and closes the shutter 65. At this time, the controller 25 operates the switch valve 59 and/or switch valve 63. When a temperature sensor, not shown, detects that an abnormality has occurred to the drying section 15, the controller 25 opens the switch valve 59 and switch valve 63 at the same time. Consequently, the shutter 65 is closed in an instant. The controller 25 opens both the switch valve 59 and switch valve 63 when operating the shutter 65 at a first speed. The controller 25 opens only the switch valve 59 when operating the shutter 65 at a second speed slower than the first speed. The controller 25 opens only the switch valve 63 when operating the shutter 65 at a third speed slower than the second speed.

The above heater 47 corresponds to the "heat source" in this invention. The fan 45 corresponds to the "ventilating mechanism" in this invention. The supply pipe 57, branch pipe 61, and switch valves 59 and 63 correspond to the "opening and closing speed regulating device" in this invention.

Figure 4:
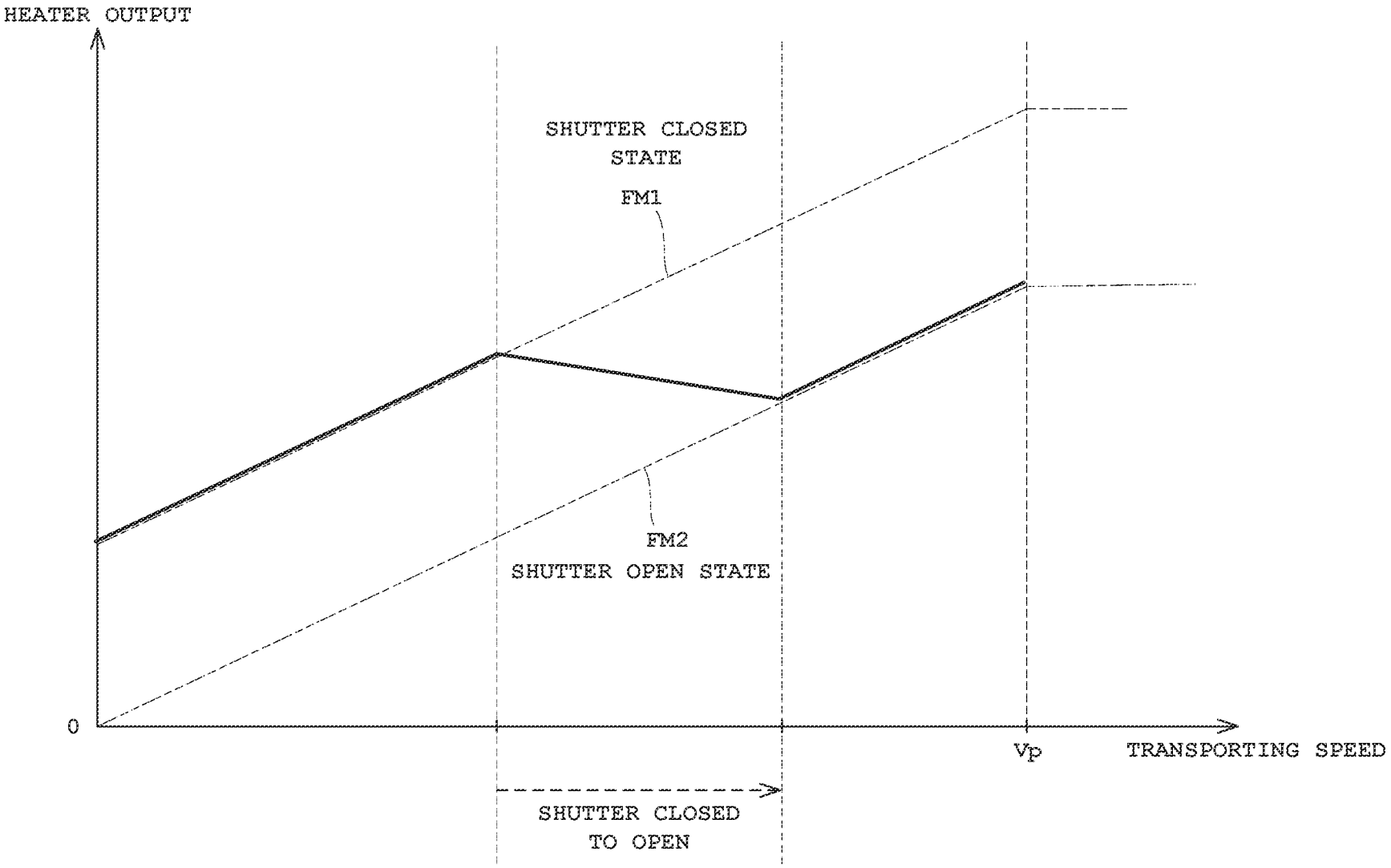
FIG. 4 is a time chart showing an example of temperature control.

The controller 25 controls the drying section 15 through the adjusting device 27. The adjusting device 27 adjusts electric power applied to the heater 47 on instructions of the controller 25. That is, the adjusting device 27 adjusts the electric power applied to the heater 47, and adjusts the amount of heat generated by the drying section 17. Reference is now made to FIG. 4. FIG. 4 is a time chart showing one example of temperature control.

Preferably, the controller 25 performs the following control of the amount of heat while controlling the opening and closing of the shutter 65 during the printing process described hereinafter.

The storage unit 29 stores, written in beforehand, a first mathematical expression FM1 and a second mathematical expression FM2 as shown in FIG. 4, for example. The first mathematical expression FM1 is an expression for determining electric power given to the heater 47 in the state where the shutter 65 is closed. The second mathematical expression FM2 is an expression for determining electric power given to the heater 47 in the state where the shutter 65 is open. The first mathematical expression FM1 and second mathematical expression FM2 are set to increase the electric power applied according to the transporting speed, respectively. An upper limit of a certain constant speed is set for the transporting speed. Thus, the first mathematical expression FM1 and second mathematical expression FM2 are set to make constant heater outputs in response to a printing speed Vp, for example.

Description will be made of a case where, as noted under the transporting speed represented by the horizontal axis in FIG. 4, for example, a state of the shutter 65 being closed at a point of time of a certain transporting speed is changed to a state of the shutter 65 being opened while increasing the transporting speed. In this case, the computing unit 31 obtains a line segment (solid line in FIG. 4) linking the first mathematical expression FM1 and second mathematical expression FM2 in response to the states of the shutter 65 by computation from the first mathematical expression FM1 and second mathematical expression FM2. Then, the computing unit 31 gives the controller 25 a heater output according to the line segment. The controller 25 operates the adjusting device 27 according to the heater output obtained.

This FIG. 4 shows a case of the shutter 65 being changed from the closed state to the open state when the transporting speed is on the increase. However, in a case of the shutter 65 being changed from the closed state to the open state when the transporting speed is on the decrease, the first mathematical expression FM1 and second mathematical expression FM2 have reversed inclinations. Still, the computing unit 31 obtains by computation a line segment extending from the second mathematical expression FM2 to the first mathematical expression FM1, and gives a heater output corresponding to the line segment to the controller 25.

By performing such amount of heat control, the amount of heat generated in the drying section 15 can be smoothly increased and decreased. Consequently, as described hereinafter, dryness variations can be further suppressed at the time of opening or closing the shutter 65 at low speed.

Figures 5A, 5B:
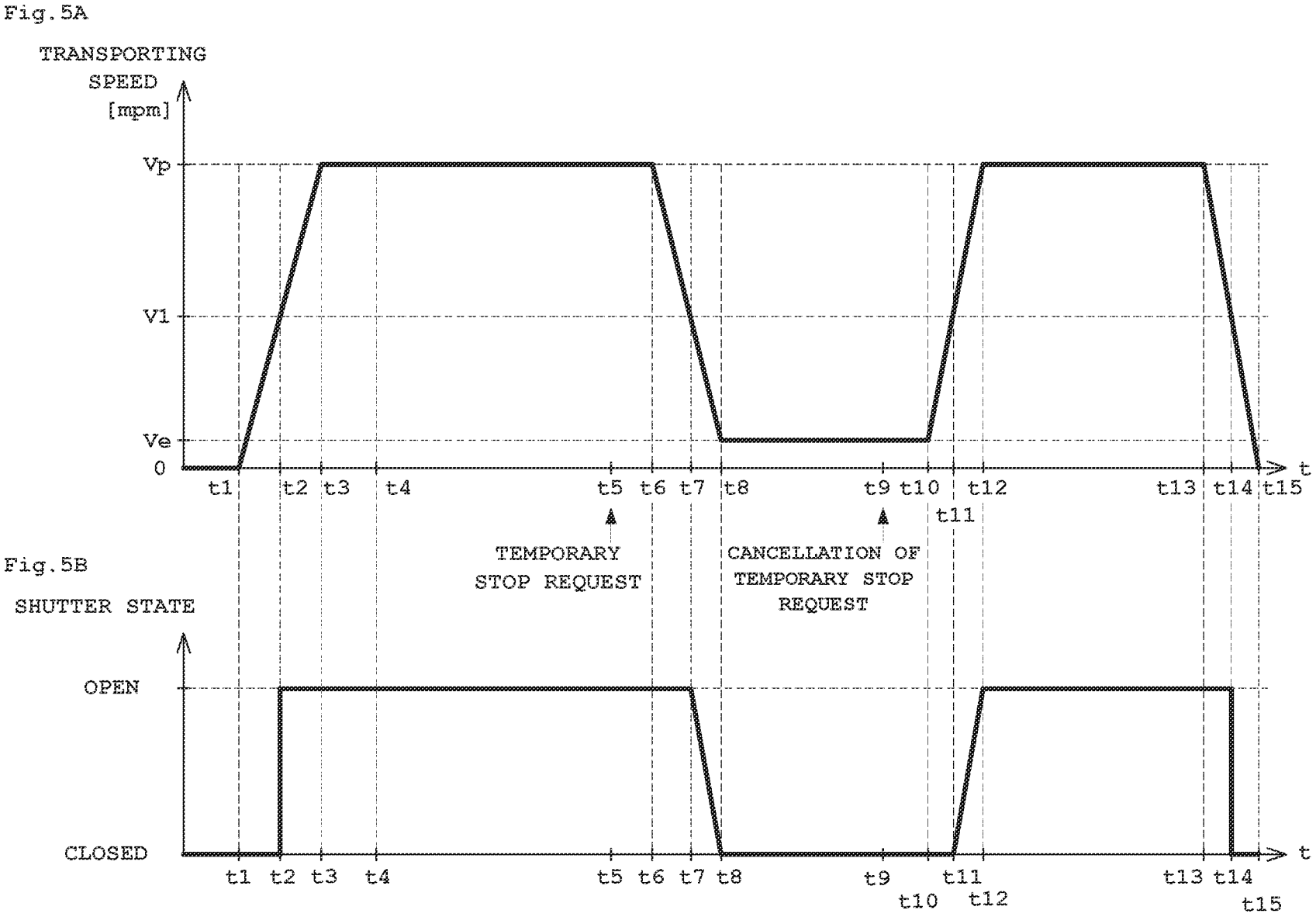
FIG. 5A is a time chart of transporting speed.
FIG. 5B is a time chart showing shutter states.

Reference is now made to FIG. 5. FIG. 5A is a time chart of the transporting speed. FIG. 5B is a time chart showing the shutter states.

In this embodiment, it is assumed that, as shown in FIG. 5A, the printing process is performed on the web paper WP while the transporting speed is controlled. It is also assumed that, at a point of time t5, a request for a temporary stop is made from a subsequent processing apparatus (not shown), and that, at a point of time t9, a request for cancellation of the temporary stop is made from the subsequent processing apparatus (not shown). It is further assumed that the printing speed Vp has been set to a transporting speed for normal times as a printing condition, and that, as a transporting speed for when a temporary stop request is made, an ultraslow speed Ve is set which is very much lower than the printing speed Vp. It is further assumed that, as a threshold for switching the opening and closing of the shutter 65, a transporting speed V1 is set which is lower than the printing speed Vp and higher than the ultraslow speed Ve.

The controller 25, in response to an instruction to start a printing process, increases the transporting speed to the printing speed Vp, from a point of time t1 to a point of time t3. Then, for example, at the point of time t3 when the transporting speed Vp is reached and becomes a constant speed, the controller 35 operates the printing unit 13 to perform printing according to the transporting speed Vp. At this time, the controller 25 performs control of the drying section 15 through the adjusting device 27 according to the transporting speed.

Specifically, the supply of electric power to the heater 47 is started at the point of time t1 when the acceleration toward the transporting speed Vp is started. Since the shutter 65 is in the closed state at this time, the computing unit 31 calculates electric power according to the transporting speed based on the first mathematical expression FM1 and, according to the result, the controller 25 operates the heater unit 49 through the adjusting device 27. The controller 25 switches the shutter 65 to the open state at a point of time t2 when the transporting speed reaches the threshold V1. At this time, the controller 25 opens the switch valves 59 and 63 at the same time to change the shutter 65 to the open state at high speed. Then, the computing unit 31 calculates electric power according to the transporting speed based on the second mathematical expression FM2 and, according to the result, the controller 25 operates the heater unit 49 through the adjusting device 27. At this time, the drying amount of heat is applied from the drying section 15 to the web paper WP.

The switch valves 59 and 63 opened to operate the shutter 65 are closed afterward. However, the shutter 65 is maintained in the open state.

As from the point of time t3 the transporting speed becomes constant as the printing speed Vp. It is assumed that, afterward, at a point of time t5, for example, the process stagnates in the subsequent processing apparatus, which then outputs a temporary stop request to the controller 25.

In this case, at a point of time t6 which is a predetermined time after the above, the controller 25 performs transport control to start deceleration at a predetermined deceleration rate so that the transporting speed may reach the ultraslow speed Ve at a point of time t8. Assume that, during this process, the transporting speed reaches the threshold V1 at a point of time t7. Then, the controller 25 switches the shutter 65 to the closed state. The controller 25 opens only the switch valve 63 to begin to close the shutter 65 at low speed from the point of time t7, and put the shutter 65 in a completely closed state at the point of time t8. At this time, the computing unit 31 obtains a line segment linking the second mathematical expression FM2 and first mathematical expression FM1, and determines electric power to be applied to the heater 47 based on this line segment. The controller 25 operates the drying section 15 through the adjusting device 27 based on the electric power determined. Although the shutter 65 of the drying section 15 is in the closed state, the minute amount of heat is applied from the drying section 15 to the web paper WP to dry the inks dispensed to the web paper WP.

The transporting speed is set to be the ultraslow speed Ve from the point of time t8 till the point of time t10. In the meantime, the controller 25 operates the printing unit 13 to continue the printing process although at the ultraslow speed. At this time, the drying section 15 is operated through the adjusting device 27 by the electric power calculated by the computing unit 31 based on the first mathematical expression FM1.

Assume that, during the printing process at the ultraslow speed Ve, at the point of time t9, for example, the controller 25 receives a signal for cancellation of the temporary stop request from the subsequent processing apparatus. Then, from the point of time t10 after a predetermined time, the controller 25 performs control to accelerate the transporting speed from the ultraslow speed Ve to the printing speed Vp, whereby the transporting speed becomes the printing speed Vp at a point of time t12. Assume that, at this time, at a point of time t11, the transporting speed reaches the threshold V1. Then, the controller 25 switches the shutter 65 to the open state at the point of time t11. Specifically, the controller 25 opens only the switch valve 63 to begin to open the shutter 65 at low speed from the point of time t11 and put the shutter 65 in a completely open state at the point of time t12. Consequently, the drying amount of heat is applied to the web paper WP in the drying section 12, thereby drying the inks dispensed to the web paper WP. At this time, the computing unit 21 obtains the line segment linking the first mathematical expression FM1 and second mathematical expression FM2 as shown in FIG. 4. And, based on this line segment, the computing unit 21 calculates electric power for application to the heater 47. The controller 25 controls the adjusting device 27 according to the electric power calculated in this way.

When the transporting speed reaches the printing speed Vp at the point of time t12, the controller 25 performs the printing process as it does from the point of time t3 to the point of time t6.

When the printing process ends just before a point of time t13, the controller 25 controls the transportation to start deceleration at the point of time t13 so that the transporting speed become 0 at a point of time t15. At a point of time t14 when the transporting speed reaches the threshold V1, the controller 25 opens the switch valves 59 and 63 to change the shutter 65 to the closed state at high speed. Since the printing process has ended and the transporting speed has also become 0 at the point of time t15, for example, the controller 25 operates the adjusting device 27 to set the electric power applied to the heater 47 to 0 and the amount of heat from the drying section 15 to 0.

The various components are controlled as described above to perform the printing process on the web paper WP.

According to this embodiment, the controller 25 switches the shutter 65 to the open state when the transporting speed of the web paper WP is faster than the predetermined threshold V1, and switches the shutter 65 to the closed state when the transporting speed of the web paper WP becomes equal to or less than the predetermined threshold V1. Consequently, when the transporting speed is faster than the predetermined threshold V1, drying is done by the drying amount of heat. When the transporting speed is a low speed equal to or less than the predetermined threshold V1, drying is done by the minute amount of heat which is less in amount of heat than the drying amount of heat. Thus, there is no chance of overdrying the inks dispensed to the web paper WP even when printing is performed at the ultraslow speed Ve. This can suppress dryness variations of the inks dispensed to the web paper WP.

After starting deceleration from a predetermined transporting speed, the controller 25 operates through the adjusting device 27 to switch the shutter 65 to the closed state at low speed at a point of time when the transporting speed reaches the threshold V1. After starting acceleration from the ultraslow transporting speed, the controller 25 operates through the adjusting device 27 to switch the shutter 65 to the open state at low speed at the point of time when the transporting speed reaches the threshold V1. Thus, while the transporting speed is shifting, the amount of heat applied from the drying section 15 to the web paper WP can be gradually decreased or increased. This can also suppress dryness variations of the inks occurring while the transporting speed is shifting.

This invention is not limited to the foregoing embodiment, but may be modified as follows:

(1) In the foregoing embodiment, the drying section 15 is constructed such that, when the shutter 65 is closed, the ventilation by the fan 45 provides the minute amount of heat. However, this invention is not limited to such construction. For example, a heater of large electric power and a heater of small electric power may be installed in the housing 41. When the shutter 65 is closed, only the heat from the heater of large electric power may be cut off, with only the heat from the heater of small electric power applied. The modified construction may switch between the drying amount of heat and the minute amount of heat in this way.

(2) In the foregoing embodiment, when the transporting speed is shifting, the opening and closing of the shutter 65 are performed at low speed. However, this invention is not limited to such switching operation. That is, when the transporting speed is shifting to exert little influence on the dryness variations of the inks, only the amount of heat may be adjusted, that is only the electric power applied to the heater 47 is adjusted, and the shutter 65 may be opened and closed at high speed.

(3) In the foregoing embodiment, in order to change the opening and closing speed of the shutter 65, the supply pipe 57, branch pipe 61, and switch valves 59 and 63 are used. However, this invention is not limited to such construction. The construction may be modified, for example, to omit the branch pipe 61 and install an electropneumatic regulator on the supply pipe 57. With this construction, an air flow rate may be changed in response to the signal inputted to the electropneumatic regulator, thereby to be able to change the extension and contraction speed of the actuator shaft in the air cylinder 55. Further, as the drive source of the shutter 65, the air cylinder 55 may be replaced with other actuators such as a motor.

(4) In the foregoing embodiment, a shift is made to the ultraslow printing process in response to a signal from the subsequent processing apparatus. However, this invention does not require the signal from the subsequent processing apparatus as indispensable. Further, this invention is applicable to a case of performing the printing process at the ultraslow speed Ve in order to catch up for lost time after some impedance occurred in the apparatus.

(5) The foregoing embodiment has been described taking for example the construction in which the drying section 15 has two heaters 47. However, this invention is not limited to such construction. That is, the drying section 15 may have at least one heater 47, or three or more heaters 47.

(6) The foregoing embodiment has been described taking the web paper as an example of printing media. However, this invention is also applicable where the printing medium is cut sheet paper or plastic film.

This invention may be embodied in other specific forms without departing from the spirit or essential attributes thereof and, accordingly, reference should be made to the appended claims, rather than to the foregoing specification, as indicating the scope of the invention.

What is claimed is:

1. An inkjet printing apparatus for printing on a printing medium by dispensing inks thereto, comprising:

a transport device for transporting the printing medium in a predetermined transport direction;

print heads for performing printing by dispensing the inks to the printing medium transported by the transport device;

a drying section disposed downstream of the print heads for drying the inks dispensed to the printing medium, and including a heat source for generating heat for drying the inks dispensed to the printing medium, and a shutter switchable between an open state and a closed state, in the open state the heat from the heat source being applied in a drying amount of heat for drying the inks dispensed to the printing medium, and in the closed state the heat from the heat source being applied in a minute amount of heat smaller than the drying amount of heat; and a controller for switching the shutter to the open state when a transporting speed of the printing medium by the transport device is faster than a predetermined threshold, and switching the shutter to the closed state when the transporting speed of the printing medium by the transport device becomes equal to or less than the predetermined threshold, wherein the drying section further includes an opening and closing speed regulating device for regulating an opening and closing speed of the shutter; and wherein the controller is configured to operate through the opening and closing speed regulating device to switch the shutter to the closed state at low speed at a point of time the transporting speed reaches the threshold when the transport device starts deceleration from a transporting speed higher than the threshold, and operate through the opening and closing speed regulating device to switch the shutter to the open state at low speed at a point of time the transporting speed reaches the threshold when the transport device starts acceleration from an ultraslow transporting speed lower than the threshold.

2. An inkjet printing apparatus according to claim 1, An inkjet printing apparatus for printing on a printing medium by dispensing inks thereto, comprising:

a transport device for transporting the printing medium in a predetermined transport direction;

print heads for performing printing by dispensing the inks to the printing medium transported by the transport device;

a drying section disposed downstream of the print heads for drying the inks dispensed to the printing medium, and including a heat source for generating heat for drying the inks dispensed to the printing medium, and a shutter switchable between an open state and a closed state, in the open state the heat from the heat source being applied in a drying amount of heat for drying the inks dispensed to the printing medium, and in the closed state the heat from the heat source being applied in a minute amount of heat smaller than the drying amount of heat; and a controller for switching the shutter to the open state when a transporting speed of the printing medium by the transport device is faster than a predetermined threshold, and switching the shutter to the closed state when the transporting speed of the printing medium by the transport device becomes equal to or less than the predetermined threshold, wherein the drying section further includes a ventilating mechanism for sending the heat generated from the heat source toward the printing medium, and in the closed state the ventilating mechanism applies the minute amount of heat to the printing medium.

3. The inkjet printing apparatus according to claim 1, wherein the drying section further includes a ventilating mechanism for sending the heat generated from the heat source toward the printing medium, and in the closed state the ventilating mechanism applies the minute amount of heat to the printing medium.

4. The inkjet printing apparatus according to claim 1, wherein:

the drying section further includes an adjusting device for adjusting an amount of heat generated by the heat source;

the controller further includes a storage unit for storing, written in beforehand, a first mathematical expression for the closed state and a second mathematical expression for the open state, expressing the amount of heat generated by the heat source which is variable to be the higher, the faster, and to be the lower, the slower the transporting speed by the transport device is; and the controller is configured to operate the adjusting device to link the first mathematical expression and the second mathematical expression when switching the shutter to the closed state at low speed and when switching the shutter to the open state at low speed.

5. The inkjet printing apparatus according to claim 1, wherein the controller is configured to decelerate the transportation by the transport device to an ultraslow speed when a temporary stop request is received from a subsequent processing apparatus disposed downstream of the drying section.

6. The inkjet printing apparatus according to claim 2, wherein the controller is configured to decelerate the transportation by the transport device to an ultraslow speed when a temporary stop request is received from a subsequent processing apparatus disposed downstream of the drying section.

7. The inkjet printing apparatus according to claim 3, wherein the controller is configured to decelerate the transportation by the transport device to an ultraslow speed when a temporary stop request is received from a subsequent processing apparatus disposed downstream of the drying section.

8. The inkjet printing apparatus according to claim 4, wherein the controller is configured to decelerate the transportation by the transport device to an ultraslow speed when a temporary stop request is received from a subsequent processing apparatus disposed downstream of the drying section.

9. The inkjet printing apparatus according to claim 1, wherein the controller is configured to accelerate the transportation by the transport device to a predetermined speed faster than an ultraslow speed when a temporary stop request is cancelled by a subsequent processing apparatus disposed downstream of the drying section.

10. The inkjet printing apparatus according to claim 2, wherein the controller is configured to accelerate the transportation by the transport device to a predetermined speed faster than an ultraslow speed when a temporary stop request is cancelled by a subsequent processing apparatus disposed downstream of the drying section.

11. The inkjet printing apparatus according to claim 4, wherein the controller is configured to accelerate the transportation by the transport device to a predetermined speed faster than an ultraslow speed when a temporary stop request is cancelled by a subsequent processing apparatus disposed downstream of the drying section.

12. The inkjet printing apparatus according to claim 5, wherein the controller is configured to accelerate the transportation by the transport device to a predetermined speed faster than an ultraslow speed when a temporary stop request is cancelled by a subsequent processing apparatus disposed downstream of the drying section.

* * * * *